US006899645B1

(12) United States Patent
Hsiao

(10) Patent No.: US 6,899,645 B1
(45) Date of Patent: May 31, 2005

(54) COMPOSITE TRAINING GOAL

(76) Inventor: Liang-Lang Hsiao, P.O. Box No. 6-57, Junghe, Taipei 235 (TW)

( * ) Notice: Subject to any disclaimer, the term of this patent is extended or adjusted under 35 U.S.C. 154(b) by 6 days.

(21) Appl. No.: 10/846,683

(22) Filed: May 17, 2004

(51) Int. Cl.[7] ..... A63B 69/00
(52) U.S. Cl. ..... 473/446; 473/477; 273/400; 273/127 B
(58) Field of Search ..... 273/398–402, 273/127 R, 127 B; 473/439, 446, 456, 470, 473/471, 476–478

(56) References Cited

U.S. PATENT DOCUMENTS

| | | | | | |
|---|---|---|---|---|---|
| 3,840,228 | A * | 10/1974 | Greaney | 473/446 |
| 4,489,940 | A * | 12/1984 | Amundson | 473/446 |
| 4,842,283 | A * | 6/1989 | LeBel et al. | 273/392 |
| 5,181,725 | A * | 1/1993 | Leras et al. | 473/446 |
| 5,271,624 | A * | 12/1993 | Sciortino | 473/446 |
| 5,564,711 | A * | 10/1996 | Scheie | 273/400 |
| 5,634,640 | A * | 6/1997 | McCarrel | 473/446 |
| 5,725,444 | A * | 3/1998 | Heden | 473/446 |
| 5,928,093 | A * | 7/1999 | Lai | 473/430 |
| 5,993,334 | A * | 11/1999 | McNamara | 473/446 |
| 6,375,585 | B1 * | 4/2002 | Driscoll | 473/477 |
| 6,402,641 | B1 * | 6/2002 | Lee | 473/446 |
| 6,695,724 | B2 * | 2/2004 | Birss | 473/446 |
| 2002/0042312 | A1 * | 4/2002 | Decloux | 473/476 |

* cited by examiner

*Primary Examiner*—Mark S. Graham

(57) ABSTRACT

A composite training goal includes a main frame having a plurality of posts and a goalkeeping frame having a handle lever movably assembled to the front of the main frame. A rail is defined in each of bottom surfaces of upper posts of the main frame and a front surface of a lower post at the rear thereof. Two rods are respectively upwardly attached to opposite ends of one upper post and a net is detachably attached between the rods whereas another net is attached to the posts of the main frame. A plurality of pulleys are respectively rotatably attached to the top surface of an upper horizontal trellis extending from an upper edge of the goalkeeping frame whereas another plurality of pulleys are rotatably attached to a rear surface of a rear bar of a lower horizontal trellis extending from a lower edge thereof.

4 Claims, 6 Drawing Sheets

COMPOSITE TRAINING GOAL

BACKGROUND OF THE INVENTION a) Field of the Invention

The present invention relates to a composite training goal, and particularly to a composite training goal with a travelling goalkeeping frame at the front thereof.

b) Description of the Prior Art

In general, a goal is an n-shaped frame vertically extending from a ground with a support bracket being formed at the rear thereof. A net is attached to the support bracket for blocking a scoring ball extending through the frame. A game rule to score a goal is that a goalkeeper defends at front of the goal for preventing an offensive player from scoring a goal. So, it is required to exercise sufficiently to improve offensive or defensive skills for a ball game to score a goal.

It usually takes a child quite a long time to exercise basic movements of a ball game for being a player. Sometimes it needs to help the child to exercise the basic movements through playing a game. However, the conventional goal is not designed to help a child to exercise or prevent a child from being hit by a ball.

SUMMARY OF THE INVENTION

Accordingly, a main object of the present invention is to provide a composite training goal including a main frame and a goalkeeping frame, wherein the main frame includes a plurality of posts assembled to have a function of a conventional goal, the goalkeeping frame is movably attached to the front of the main frame with a handle lever thereof extending to the rear of the main frame whereby a user can control the movement of the goalkeeping frame through moving the handle lever as a goalkeeper keeps goal, so a net attached above the main frame prevents the user from being hit by a ball.

Another object of the present invention is to provide a composite training goal, wherein when a net above a main frame is detached, two rods at opposite sides of the main frame for attaching the net make the composite training goal have a function of a conventional goal for American football.

Further object of the present invention is to provide a composite training goal, wherein a rail is defined in each of bottom surfaces of upper posts of a main frame and a front surface of a lower post at the rear of the main frame, and pulleys are attached to a goalkeeping frame and engage with the rails whereby the goalkeeping frame is moveable right and left at the front of the main frame.

Other objects, advantages and novel features of the present invention will be drawn from the following detailed embodiment of the present invention with attached drawings, in which:

DETAILED DESCRIPTION OF THE PREFERRED EMBODIMENT

Figure 1:
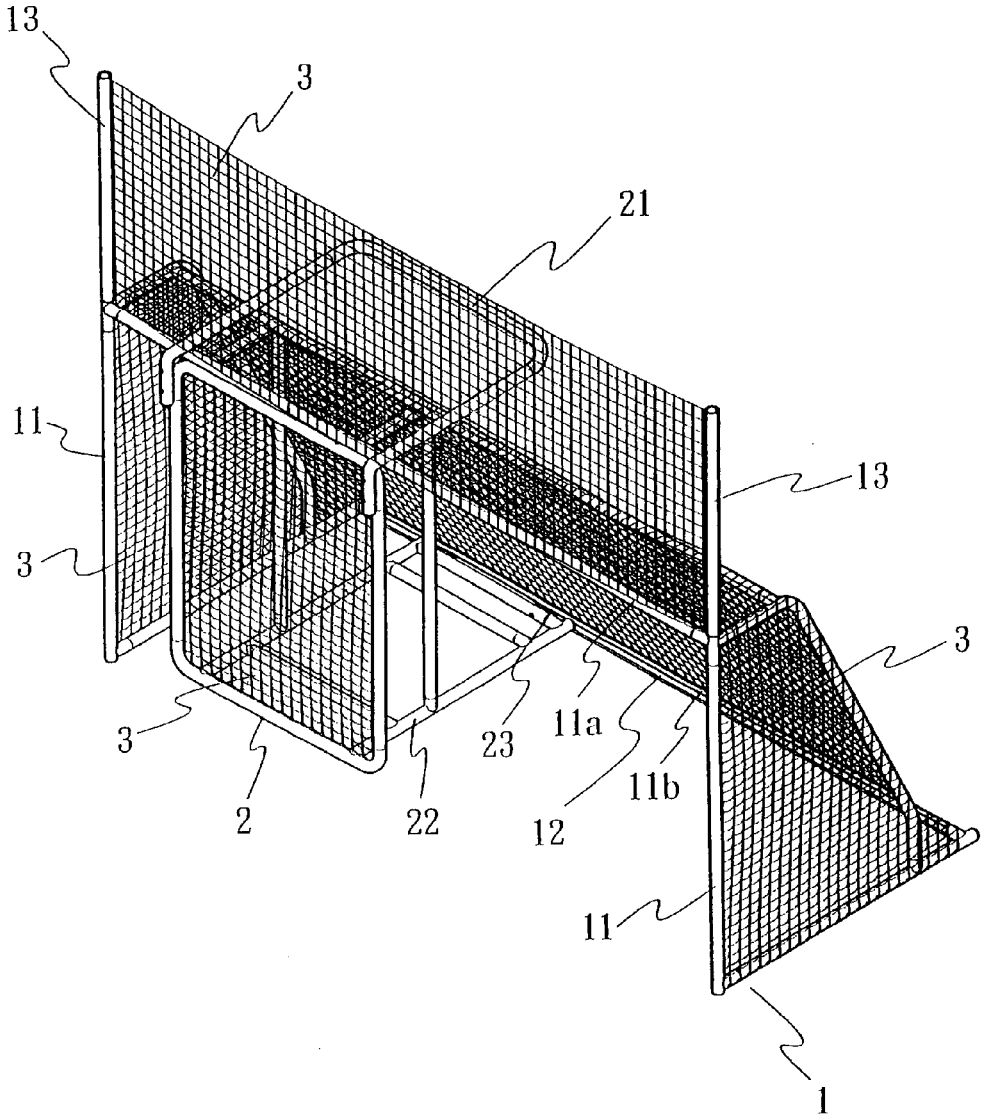
FIG. 1 is an assembled view of a composite training goal of the present invention.
Figure 2:
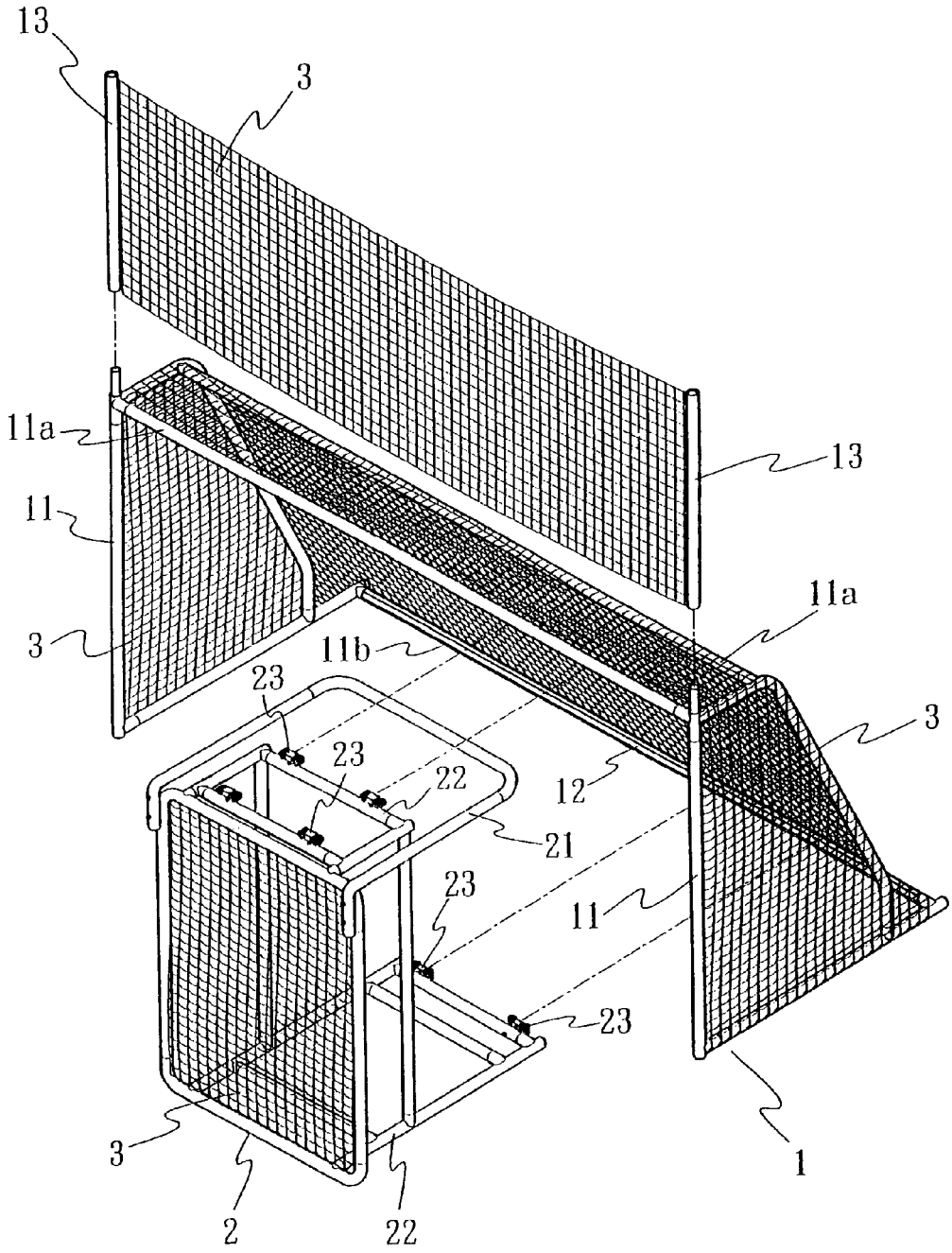
FIG. 2 is an exploded view of FIG. 1.

Referring to FIGS. 1 and 2, a composite training goal of the present invention includes a main frame 1 and a goalkeeping frame 2.

The main frame 1 includes a plurality of posts 11 assembled to have a function of a conventional goal. A rail 12 is defined in each of bottom surfaces of upper posts 11*a* of the main frame 1 and a front surface of a lower post 11*b* at the rear of the main frame 1. Two rods 13 are upwardly attached to opposite ends of one upper post 11*a* at the front of the main frame 1, respectively. A net 3 is detachably attached between the rods 13.

The goalkeeping frame 2 is assembled to the front of the main frame 1 and is generally rectangular with another net 3 being attached therein. An n-shaped handle lever 21 extends upwardly and then rearwards from the goalkeeping frame 2. The handle lever 21 is generally horizontal at the rear of the goalkeeping frame 2. Upper and lower horizontal trellises 22 respectively extend rearwards from upper and lower edges of the goalkeeping frame 2. A plurality of pulleys 23 is respectively rotatably attached to the top surface of the upper horizontal trellis 22 for engaging with the rails 12 of the upper posts 11*a*. Another plurality of pulleys 23 is rotatably attached to a rear surface of a rear bar of the lower horizontal trellis 22 for engaging with the rail 12 of the lower post 11*b*. Thus, the goalkeeping frame 2 is movable right and left along the rails 12 of the main frame 1 through the pulleys 23.

In assembly, another net 3 is attached to the posts 11 of the main frame 1. The goalkeeping frame 2 is movably attached to the front of the main frame 1 with the pulleys 23 thereof engaging with the rails 12. The handle lever 21 extends rearwards above the main frame 1. Thus movement of the goalkeeping frame 2 can be controlled at the rear of the main frame 1 thereby forming the composite training goal of the present invention.

Figure 3:
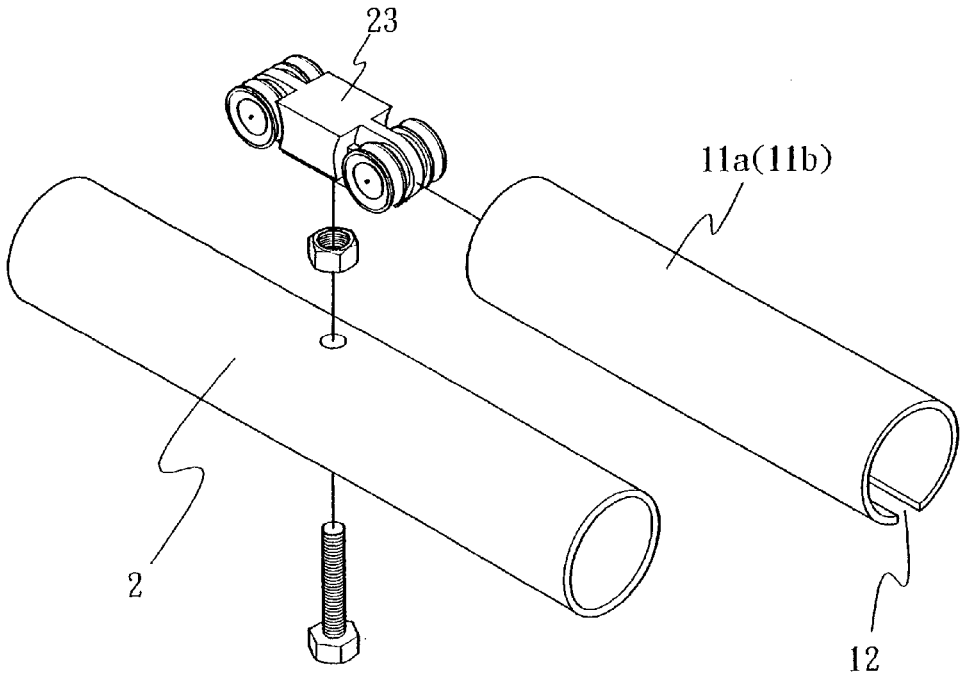
FIG. 3 is an exploded view of a pulley and a rail.
Figure 4:
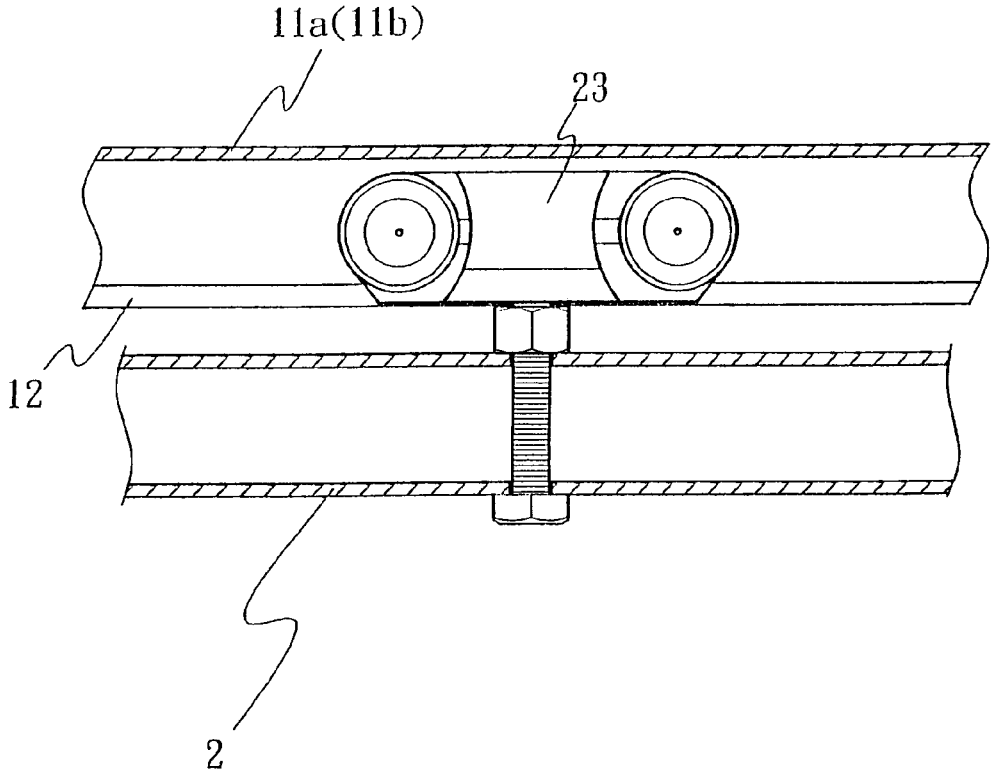
FIG. 4 is a cross-sectional and assembled view of FIG. 3.

Furthermore, as shown in FIGS. 3 and 4, the pulleys 23 of the goalkeeping frame 2 are movably received in the rails 12 of the upper posts 11*a* and the lower post 11*b* and then the upper and lower posts 11*a*, 11*b* connect with other posts 11 to form the main frame 1. Then, the pulleys 23 are respectively fixed to the horizontal trellises 22 of the goalkeeping frame 2 whereby the goalkeeping frame 2 is slidably attached to the front of the main frame 1.

Figure 5:
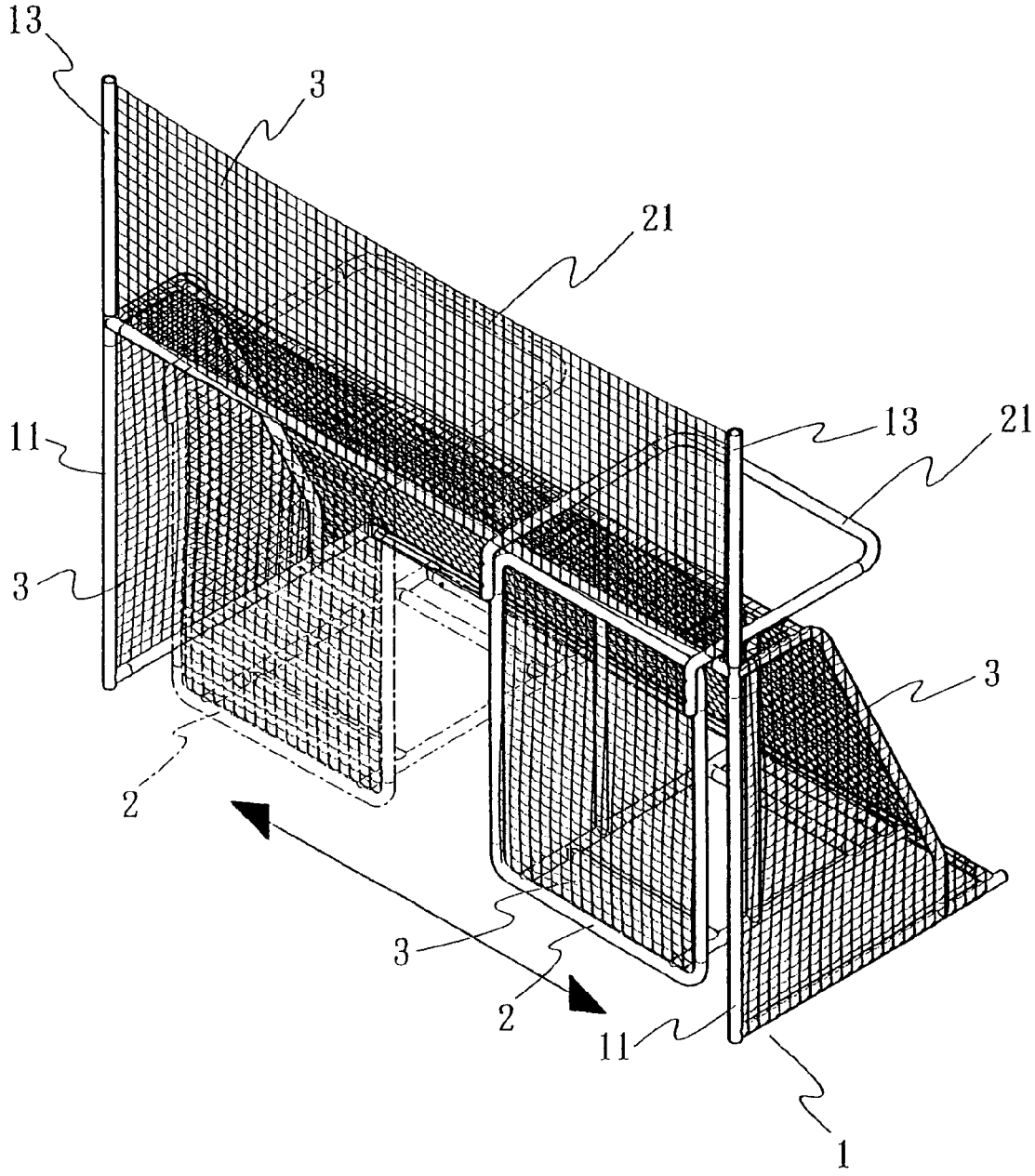
FIG. 5 is a schematic view showing one use situation of the composite training goal.

In addition, in use, a user can hold and move the handle lever 21 of the goalkeeping frame 2 at the rear of the main frame 1 and so control the movement of the goalkeeping frame 2 (as shown in FIG. 5) as a goalkeeper keeps goal, to block a shot ball with the net 3 of the goalkeeping frame 2. Moreover, the net 3 is attached between the rods 13 for preventing a ball above the main frame 1 from hitting the user.

Figure 6:
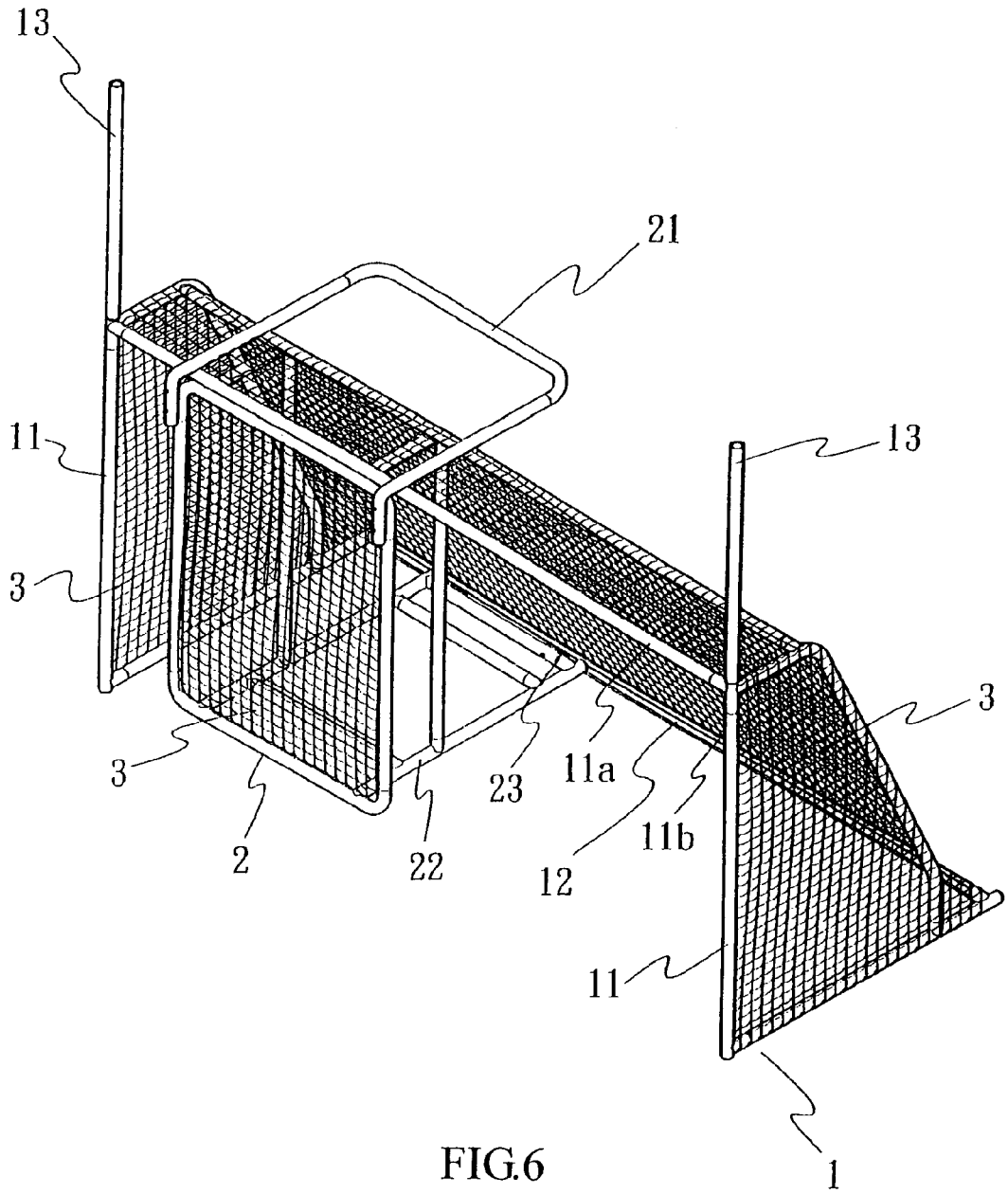
FIG. 6 is similar to FIG. 5 but showing another use situation of the composite training goal.

The net 3 attached between the rods 13 also can be detached (as shown in FIG. 6) whereby the rods 13 make the composite training goal have a function of a conventional goal for American football.

In addition, the posts 11 can be detached and so the composite training goal has a small packaging volume, which reduces storage space, transportation space and therefore cost.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A composite training goal comprising a main frame and a goalkeeping frame, wherein:

the main frame includes a plurality of posts, a rail is defined in each of bottom surfaces of upper posts of the main frame and a front surface of a lower post at the rear of the main frame, two rods are respectively upwardly attached to opposite ends of one upper post at the front of the main frame, a net is detachably attached between the rods;

the goalkeeping frame is movably assembled to the front of the main frame and is generally rectangular with another net being attached therein, a handle lever extends upwardly and then rearwards from the goalkeeping frame, upper and lower horizontal trellises respectively extend rearwards from upper and lower edges of the goalkeeping frame, a plurality of pulleys is respectively rotatably attached to the top surface of the upper horizontal trellis, another plurality of pulleys is rotatably attached to a rear surface of a rear bar of the lower horizontal trellis;

another net is attached to the posts of the main frame, the goalkeeping frame is movably attached to the front of the main frame with the pulleys thereof engaging with the rails, the handle lever extends rearwards above the main frame, thus movement of the goalkeeping frame is controllable at the rear of the main frame.

2. The composite training goal as claimed in claim 1, wherein the handle lever is n-shaped and is generally horizontal at the rear of the goalkeeping frame.

3. The composite training goal as claimed in claim 1, wherein the pulleys of the top surface of the upper horizontal trellis of the goalkeeping frame engage with the rails of the upper posts of the main frame.

4. The composite training goal as claimed in claim 1, wherein the pulleys of the rear surface of the rear bar of the lower horizontal trellis of the goalkeeping frame engage with the rail of the lower post of the main frame.

* * * * *